US009896224B2

(12) United States Patent
Beer

(10) Patent No.: US 9,896,224 B2
(45) Date of Patent: Feb. 20, 2018

(54) FORM, FILL AND SEAL APPARATUS AND METHODS FOR APPLYING ONE-WAY VALVES TO FLEXIBLE PACKAGES

(71) Applicant: Fres-co System USA, Inc., Telford, PA (US)

(72) Inventor: Jeffrey Scott Beer, Coopersburg, PA (US)

(73) Assignee: Fres-co System USA, Inc., Telford, PA (US)

( * ) Notice: Subject to any disclaimer, the term of this patent is extended or adjusted under 35 U.S.C. 154(b) by 420 days.

(21) Appl. No.: 14/662,534

(22) Filed: Mar. 19, 2015

(65) Prior Publication Data

US 2015/0266596 A1 Sep. 24, 2015

Related U.S. Application Data

(60) Provisional application No. 61/969,452, filed on Mar. 24, 2014.

(51) Int. Cl.

| | |
|---|---|
| ***B65B 1/02*** | (2006.01) |
| ***B65D 51/16*** | (2006.01) |
| ***B65B 1/18*** | (2006.01) |
| ***B65B 43/46*** | (2006.01) |
| ***B65B 61/00*** | (2006.01) |
| *B65D 77/22* | (2006.01) |
| *B65B 51/14* | (2006.01) |

(52) U.S. Cl.

CPC ..... *B65B 1/02* (2013.01); *B65B 43/465* (2013.01); *B65B 61/00* (2013.01); *B65B 51/146* (2013.01); *B65D 77/225* (2013.01)

(58) Field of Classification Search

CPC ..... B65D 77/225; B65B 1/02; B65B 43/465; B65B 51/146; B65B 61/00

USPC ..... 53/410

See application file for complete search history.

(56) References Cited

U.S. PATENT DOCUMENTS

| | | | | |
|---|---|---|---|---|
| 4,290,253 A * | 9/1981 | Domke | B65D 31/14 | 493/213 |
| 4,690,667 A * | 9/1987 | Domke | B65B 61/186 | 383/103 |
| 7,178,550 B2 * | 2/2007 | Stotkiewitz | B65B 61/00 | 137/246 |

* cited by examiner

*Primary Examiner* — Robert Long
*Assistant Examiner* — Xavier A Madison
(74) *Attorney, Agent, or Firm* — Caesar Rivise, PC

(57) ABSTRACT

Disclosed are apparatus and methods for producing bags filled with a flowable particulate material from a continuous tube of flexible material. The apparatus includes a one-way valve application station having a valve applicator mechanism and a cutting and heating mechanism configured for movement with the bag through the apparatus. The valve applicator mechanism holds a one-way valve for insertion within the bag as the bag is moved through the apparatus. The cutting and heating mechanism is configured to be moved in unison with the valve applicator mechanism to cooperate with it to cut a vent hole in the bag at the valve and to weld the valve to the bag. Then the valve applicator mechanism and the cutting and heating mechanism are moved to apply another one-way valve to another filled bag and the bag with the valve secured thereto is sealed. The resulting sealed bag is suitable for stable palletization.

20 Claims, 3 Drawing Sheets

FORM, FILL AND SEAL APPARATUS AND METHODS FOR APPLYING ONE-WAY VALVES TO FLEXIBLE PACKAGES

CROSS-REFERENCE TO RELATED APPLICATIONS

This utility application claims the benefit under 35 U.S.C. § 119(e) of Provisional Patent Application Ser. No. 61/969,452 filed on Mar. 24, 2014 entitled Form, Fill and Seal Apparatus and Methods For Applying One-Way Valves to Flexible Packages. The entire disclosure of that provisional application is incorporated by reference herein.

BACKGROUND OF THE INVENTION

This invention relates generally to packaging apparatus and more particularly to to form, fill and seal apparatus and methods for applying one way valves on packages formed from of tubular film stock using such apparatus.

Packaging large, e.g., approximately 50 pounds or 25 kilograms, of free flowing dry products in an appropriately sized bag and then stacking those filled bags onto a pallet for shipping has been done for many years. Historically the bag has been made from multiple layers of paper, plastic and sometimes aluminum foil. The bags seams have been closed by sewing or by gluing. When the bags are stacked onto a pallet, the air is allowed to escape the bag from the seams. This practice allows atmospheric moisture to enter the bag through the seams. Hygroscopic products such as nylon resin historically had issues with moisture gain when packaged by this method.

In the 1980's, pre-made heat sealed bags composed of moisture barrier laminates and fitted with one-way valves solved the problems with moisture gain seen on packages with sewn or glued seams. The seams of these bags do not allow air to escape and do not allow moisture to enter. The purpose of the one-way valve is to allow air to escape the bag when subjected to pressure from stacking bags on a pallet. Once the air pressure is relieved, the valve is closed and no moisture can enter the bag.

Recently rolls of plastic tubing have been utilized along with automatic fill and seal equipment to package free flowing dry products. The seams of these packages are leak free and the finished filled bags therefore need to be vented to allow air escape during palletization. Numerous methods have been used to vent these bags from simple punctures to elaborate tortuous paths. However, it has been determined that such vents are not as effective as desired inasmuch as they tend to allow moisture back into the package.

Therefore, there exists a need to improve the moisture barrier of the tube based bag due to moisture gain through the vents.

Further attempts have been made to remove air by displacement or vacuumization during the form and fill process, e.g., the form, fill and seal machines include a vacuum station for removing air from the interior of the package. However, the resulting packages are inconsistent in the amount of residual air left within the package, thereby resulting in poor palletization performance. In particular, when too much air is left, the bags on the lower pallet layers become pressurized making an unstable pallet load. When too much air is removed before palletization the bags hold the shape from filling and cannot flatten out to create a stable pallet load.

Thus, a need exists for apparatus configured to utilize a continuous tube of flexible material to form it into a series of flexible bag, to sequentially fill the bags, to apply a one-way valve to the bags, and to seal the bags, to provide bags which can be readily palletized. The subject invention addresses that need. To that end, the subject invention provides apparatus and method for producing packages, each including a one-way valve that allows air to escape from the package yet without allowing air to enter the package. Since those valves enable air to escape from each of the packages during palletization the packages can conform to one another creating a stable pallet load. Once air has escaped, the valve of each package closes and moisture cannot enter the package.

SUMMARY OF THE INVENTION

One aspect of this invention is apparatus for producing a bag filled with a flowable particulate material. The apparatus has plural stations, one of which being a valve applicator station. The at least one of the stations is configured to form a bag from a continuous tube of flexible material and for introducing the flowable particulate material into the bag to produce a filled bag having an open mouth. The apparatus is configured for moving the filled bag along a path through the valve application station. The valve application station comprises a valve applicator mechanism and a cutting and heating mechanism. The valve applicator mechanism and the cutting and heating mechanism are each configured for movement along the path in synchronism with the movement of the bag along the path. The valve applicator mechanism is configured for holding a one-way valve thereon and is configured to be moved with respect to the bag for insertion within the bag as the bag is moved along the path to dispose the one-way valve against a portion of the interior of the bag. The cutting and heating mechanism is configured to be moved with respect to the bag as the bag is moved along the path to dispose the cutting and heating mechanism in alignment with the one-way valve to cut a vent hole in the bag and for thermally securing the one-way valve to the bag. The valve applicator mechanism and the cutting and heating mechanism are also configured to be moved away from the bag after the one-way valve is secured thereto and also moved backward along the path to a position to apply another one-way valve to another filled bag. The apparatus is also configured to seal the mouth of the bag after the one-way valve has been secured thereto.

Another aspect of this invention is apparatus for use in, e.g., retrofitting, a form, fill and seal machine for applying a one-way valve to a flexible bag filled with a flowable particulate material moving in a path through the machine. The apparatus comprises a valve applicator mechanism and a cutting and heating mechanism, each of which is configured for movement along the path in synchronism with the movement of the bag along the path. The valve applicator mechanism holds a one-way valve thereon and is configured to be moved with respect to the bag for insertion within the bag as the bag is moved along the path to dispose the one-way valve against a portion of the interior of the bag. The cutting and heating mechanism is also configured to be moved with respect to the bag as the bag is moved along the path to dispose the cutting and heating mechanism in alignment with the one-way valve to cut a vent hole in the bag and for thermally securing the one-way valve to the bag. The valve applicator mechanism and the cutting and heating mechanism are configured to be moved away from the bag after the one-way valve is secured thereto and also moved backward along the path to a position to apply another one-way valve to another filled bag.

Still another aspect of this invention constitutes a method of producing a bag filled with a flowable particulate material. The method entails using an apparatus having plural stations, one of which being a valve applicator station. A tube of flexible material is provided to at least one of the stations to form a bag. A flowable particulate material is introduced into the bag to produce a filled bag having an open mouth. The filled bag is moved along a path through the valve application station. The valve application station comprises a valve applicator mechanism and a cutting and heating mechanism. The valve applicator mechanism and the cutting and heating mechanism are each moved along the path in synchronism with the movement of the bag along the path. The valve applicator mechanism holds a one-way valve thereon and is moved into the bag as the bag is moved along the path to dispose the one-way valve against a portion of the interior of the bag. The cutting and heating mechanism is also moved with respect to the bag as the bag is moved along the path to dispose the cutting and heating mechanism in alignment with the one-way valve to cut a vent hole in the bag and for thermally securing the one-way valve to the bag. The valve applicator mechanism and the cutting and heating mechanism are moved away from the bag after the one-way valve is secured thereto and also moved backward along the path to a position to apply another one-way valve to another filled bag. The mouth of the bag is sealed after the one-way valve has been secured thereto.

Yet another aspect of this invention constitutes a method of retrofitting a form, fill and seal machine having plural stations to produce a bag filled with a flowable particulate material from a tube of flexible material. The machine is configured such that the bag is moved in a path through it. The method comprises providing the machine with a valve applicator station. The valve application station comprises a valve applicator mechanism and a cutting and heating mechanism, each of which is configured for movement along the path in synchronism with the movement of the bag along the path. The valve applicator mechanism holds a one-way valve thereon and is configured to be moved with respect to the bag for insertion within the bag as the bag is moved along the path to dispose the one-way valve against a portion of the interior of the bag. The cutting and heating mechanism is also configured to be moved with respect to the bag as the bag is moved along the path to dispose the cutting and heating mechanism in alignment with the one-way valve to cut a vent hole in the bag and for thermally securing the one-way valve to the bag. The valve applicator mechanism and the cutting and heating mechanism are configured to be moved away from the bag after the one-way valve is secured thereto and also moved backward along the path to a position to apply another one-way valve to another filled bag.

In accordance with one aspect of the above retrofitting method the form, fill and seal machine initially comprises a vacuumization station, wherein the vacuumization station is replaced by the valve applicator station.

DETAILED DESCRIPTION OF THE PREFERRED EMBODIMENT

Figure 1:
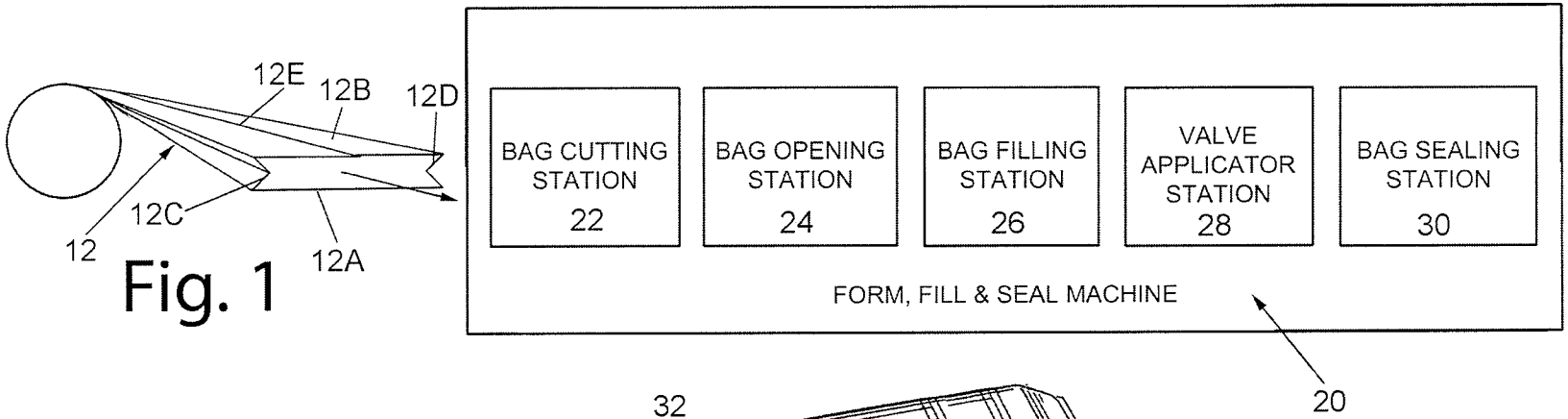
FIG. 1 is a block diagram illustration showing a form, fill and seal apparatus constructed in accordance with one aspect of this invention for applying one way valves to flexible packages formed from a continuous gusseted tube of flexible material, with each of the various stations of the apparatus being shown by a designated block.
Figure 2:
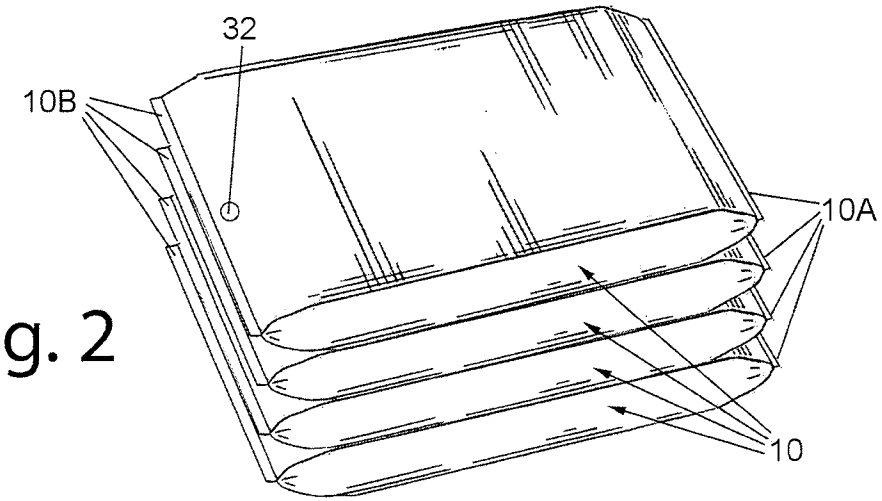
FIG. 2 is an isometric view of a stack of flexible packages produced by the apparatus and methods of this invention and which packages are suitable for palletization.

Referring now to the various figures of the drawing wherein like reference characters refer to like parts, there is shown at 20 in FIG. 1 one exemplary embodiment of an apparatus 20 to produce and fill a series of flexible packages or bags 10 with a dry granular product, e.g., a hydroscopic material. Each bag includes a one-way valve (to be described later), so that air within the bag can escape through the valve when the filled bags are palletized or otherwise stacked like shown in FIG. 2, but which will prevent the ingress of air into each bag.

The apparatus 20 comprises a form, fill and seal machine having at least a bag cutting station 22, a bag opening station 24, a bag filling station 26, a valve applicator station 28 and a bag sealing station 30 to produce and fill a series of such bags 10. The apparatus 20 produces those bags from a continuous tube of flexible material 12, which is wound up on a roll or reel. In the exemplary embodiment shown the tube of flexible material includes a front wall or panel 12A, a rear wall or panel 12B a pair of side gussets 12C and 12D and a longitudinal (machine direction) lap seal 12E in the rear wall or panel 12B. A portion of the tube 12 is unwound from the reel and introduced into the apparatus 20 where it is provided to the bag cutting station 22. At this station the given length section of the tube 12 is cut and a bottom, transverse seal 10A applied to form a hollow bag 10 having an open top mouth 10B, like shown in FIG. 3. The mouth 10B is located between the upper edges of the front and rear panels 12A and 12B, respectively, and the side gussets 12C and 12D. From there, the cut bag 10 moves to the bag opening station 24 shown in FIG. 4, where the bag's mouth 10B is opened, by means to be described later. From there the bag 10 with its opened mouth is moved to the bag filling station 26 shown in FIG. 5, where a filler mechanism, also to be described in detail later, is introduced through the opened mouth to fill the bag with the dry free-flowing granular products or materials 14, e.g., a nylon resin. From there the filled bag 10 is moved to the valve applicator station 28 shown in FIG. 6, where a valve applicator mechanism, also to be described in detail later, is introduced through the opened mouth to apply a one-way valve 32 to either the front wall (panel) or the rear wall (panel) of the filled bag. From there the filled valved bag 10 is moved to the bag sealing station 30 shown in FIG. 7, where a mouth sealing mechanism, also to be described in detail later, engages the top portions of the walls (panels) of the bag at the mouth to seal the mouth and thus produce a finished filled valved bag 10.

It should be pointed out at this juncture that the form, fill and seal apparatus 20 may be specially constructed in accordance with this invention or may be retrofitted from an existing commercially available form, fill and seal machine, e.g., a vertical form, fill and seal machine. In the latter case, if the form, fill and seal machine included a vacuumization station for evacuating the air from the package, that station is replaced by the valve applicator station 28.

As should be appreciated by those skilled in the art a vacuumization station isn't needed in the form, fill and seal machine of this invention since the bag will be equipped with a one-way valve, thereby eliminating the need to actively remove the air from the package. The substitution of the valve applicator station for a vacuumization station is also propitious since there is virtually no other room or place in commercially available form, fill and seal machines other than at what would be the vacuumization station to include a valve applicator, like that of the subject invention, i.e., one that is configured to introduced into the open mouth of the bag and moved along with the bag through the machine at that station (as will be described in detail later).

In the interest of brevity, the details of the construction and operation of the bag cutting station 22, the bag opening station 24, the bag filling station 26 and the bag sealing station 30 will only be described briefly, since each of those stations is of conventional construction. Thus, for example, means (not shown) are provided at the bag cutting station 22 to produce, e.g., weld, the transverse seal across the tube 12 to create the bottom seal 10A for the next successive bag 10 and the tube 12 is cut below the bottom seal to produce the mouth of the next successive bag. The amount of the tube 12 that is unwound from the reel is predetermined and selected to establish the particular desired length of the bag to be produced. Thus, with such a machine any length of bag can be produced thereby.

Figures 3, 4, 5, 6, 7:
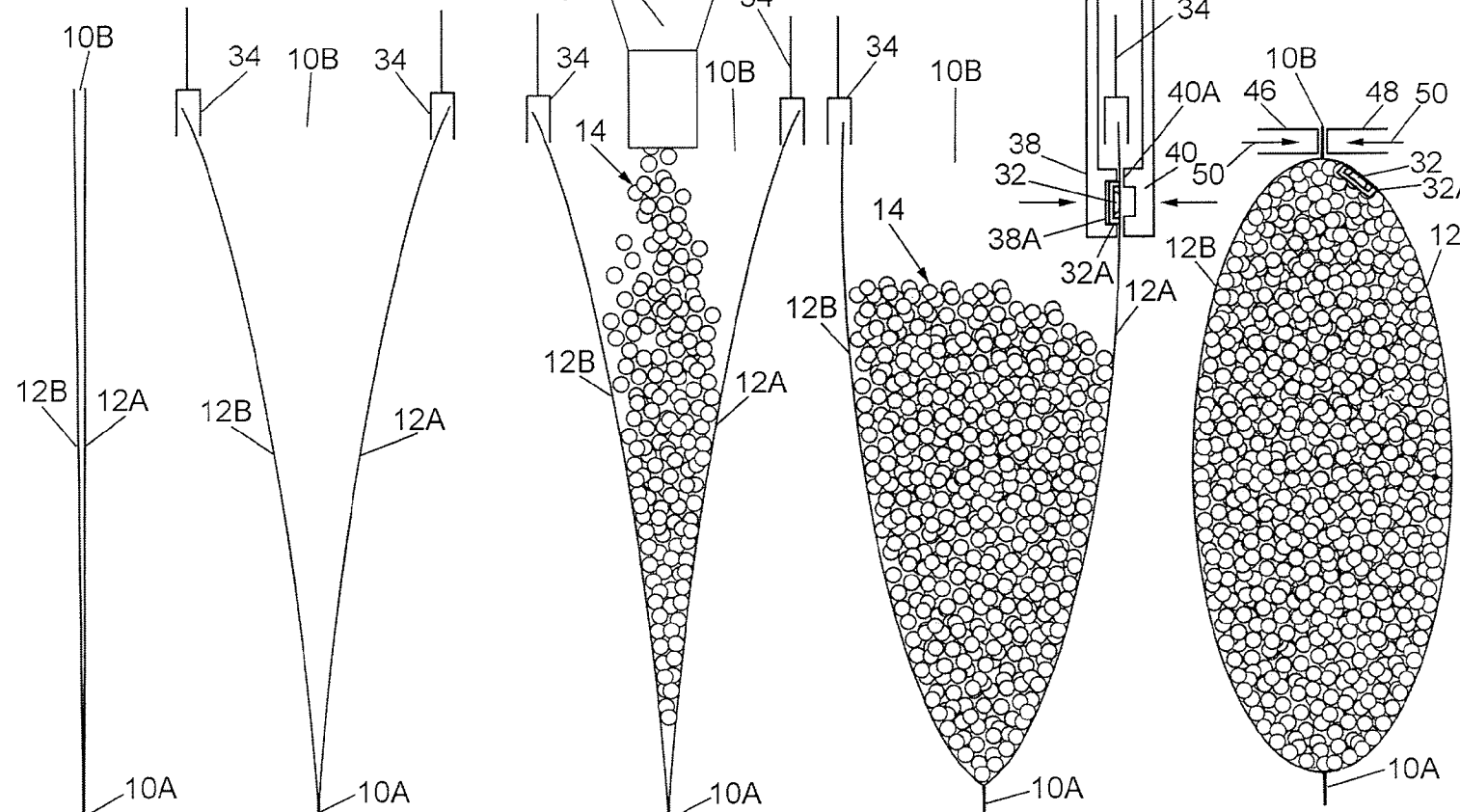
FIG. 3 is vertical sectional view of a flexible bag after it has been cut from a continuous gusseted tube of flexible material at the bag cutting station of the apparatus shown in FIG. 1.
FIG. 4 is vertical sectional view of the flexible bag as its mouth is being opened at the bag opening station of the apparatus shown in FIG. 1.
FIG. 5 is vertical sectional view of the flexible bag as it is filled with granular or particulate material at the bag filling station of the apparatus shown in FIG. 1.
FIG. 6 is vertical sectional view of the filled flexible bag as the one-way valve is being applied to the bag at the valve applicator station of the apparatus shown in FIG. 1.
FIG. 7 is vertical sectional view of the filled flexible bag after the valve has been applied and the mouth of the bag is being sealed at the bag sealing station of the apparatus shown in FIG. 1.

As best seen in FIG. 4, the bag opening station 24 includes a bag opening mechanism, e.g., a pair of jaws 34, which are configured to grasp the upper end portions of the front and rear panels 12A and 12B. Other conventional bag opening mechanisms, e.g., suction cups, etc., can be used to grasp the upper end portions of the front and rear panels 12A and 12B to open the mouth, if desired.

The bag filling station 26 is best seen in FIG. 5 and includes a filler mechanism 36. The filler mechanism 36 is configured to reciprocate into the mouth of the bag to dispense a metered amount of the dry readily flowable granular material 14 into the hollow interior of the bag while the jaws 34 (or other bag opening mechanism) holds the mouth open. The filling mechanism reciprocates out of the bag's mouth when the bag has been filled with the desired amount of material 14.

Figure 8:
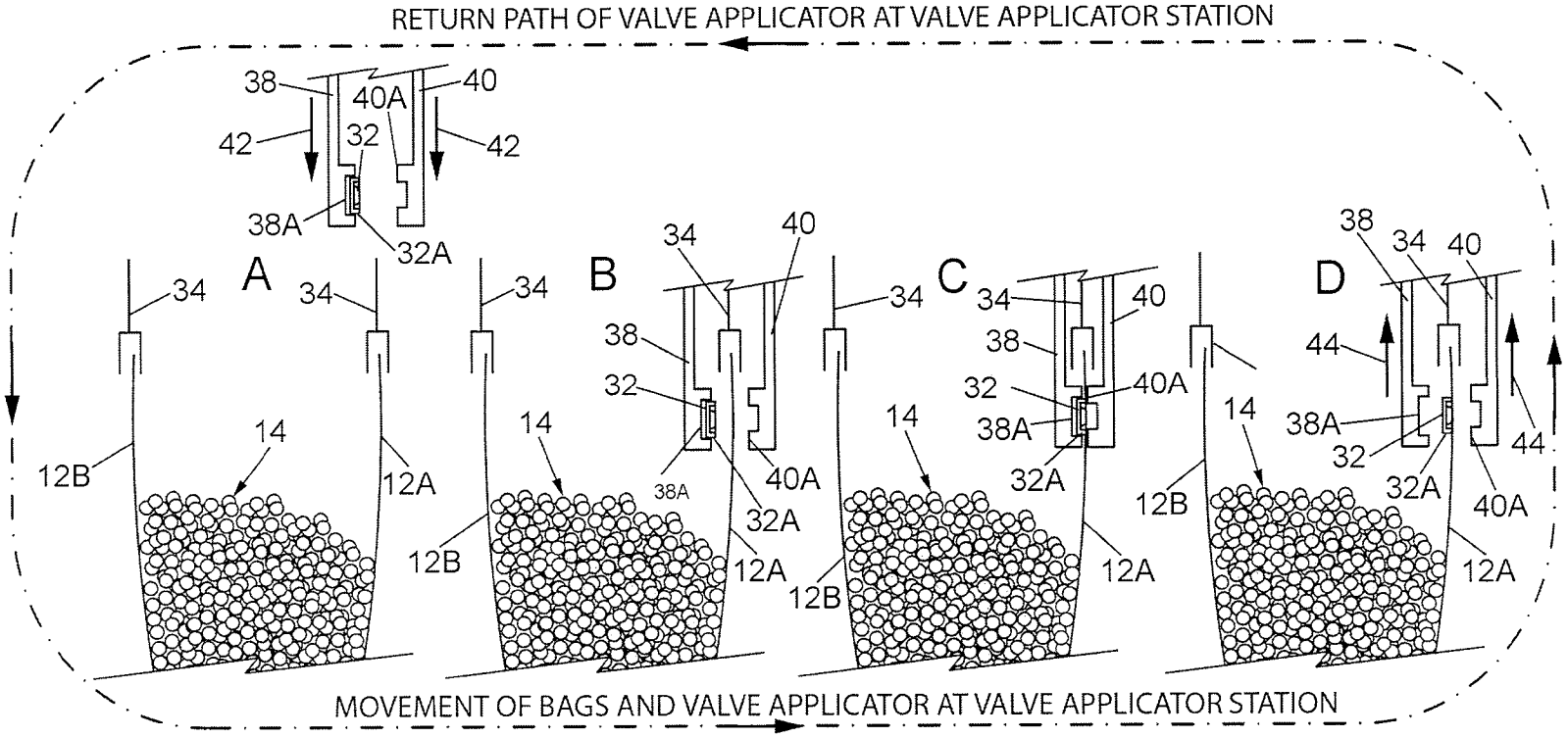
FIG. 8 is an illustration of the upper portion of the filled bag showing its movement through the valve applicator station and the manner at which the valve applicator mechanism at that station moves along with the bag down the station and then returns to the beginning of that station to apply a one-way valve to the next succeeding filled bag.

The valve applicator station 28 is shown in FIGS. 6 and 8 and basically comprises a carrier (not shown) on which a pair of jaw-like members 38 and 40 are mounted or otherwise coupled. The carrier with the jaw-like members 38 and 40 mounted thereon is configured to move in unison with the bag 10 through the valve applicator station 28 in the path shown by the bottom portion of broken line in FIG. 8 in the direction of the arrow therein from the position designated by the letter "A", through the position designated by the letter "B", through the position designated by the letter "C", and through the position designated by the letter "D", from whence the carrier and the jaw-like members move back to the position "A" so that another valve can be applied to the next successive filled bag.

The jaw-like member 38 serves as a valve applicator mechanism. To that end, it is configured to carry the one-way valve 32 into the interior of the bag so that the valve can be secured to a portion of the interior surface of a wall of the bag. In the exemplary embodiment shown the jaw-like member 38 is an elongated member that includes a lower end portion having a cavity 38A in which the valve 32 is disposed. The valve 32 can be of any suitable construction, such as that sold by Fres-co System USA, Inc., the assignee of this invention. That valve includes a flange 32A. The flange is configured to be welded or otherwise thermally secured to a wall of the bag to secure the valve in place within the interior of the bag. After the jaw-like member 38 has been extended into the mouth of the bag it is configured to be moved toward the interior surface of the wall of the bag bring the valve's flange into engagement with the inner surface of the bag so that it can be welded or otherwise thermally secured to the bag, as will be described soon.

The jaw-like member 40 is in the form of a punch/seal mechanism that is configured to cooperate with the jaw-like member 38 to cut or punch a hole through the wall of the bag at the location of the valve and to cooperate with the jaw-like member 38 to weld or otherwise thermally secure the valve to the wall of the bag. To that end, it is configured to be moved toward the wall of the bag from the outside of the bag to interpose the wall of the bag between it and the valve 32 held in the jaw-like member 38.

It should be pointed out at this juncture that the valve 32 can be welded to the inner surface of either the front wall 12A or rear wall 12B of the bag 10, whichever is desired. In the exemplary embodiment shown in FIG. 8 the valve 32 is welded to the inner surface of the front wall 12A of the bag 10.

The punch/seal mechanism of the jaw-like member 40 includes a cutter, e.g., a retractable/extendable knife (not shown), and a surrounding pressure applying contact surface or face 40A. The extendable/retractable knife is configured to be brought into engagement with the wall of the bag at the location of the valve as the valve is held by the juxtaposed jaw-like member 38 to thereby cut a vent hole in that wall of the bag at the valve. The pressure applying face 40A of the jaw-like member 40 is heated by any suitable means (not shown) so that when it is brought into engagement with the wall of the bag it heats the interposed portion of the wall of the bag and valve's flange 32A while applying pressure to them to weld the valve in place in the bag with the valve in fluid communication with the vent hole.

As stated above, the jaw-like members 38 and 40 are configured to move in unison with the bag 10 as the bag moves through the valve applicator station 28, i.e., through the positions A-D. Moreover, they also are configured to be extended (preferably in unison) in the direction of arrows 42 from a retracted position shown in the portion of FIG. 8 designated by the letter "A" to the extended position shown in the portion of that figure designated by the letter "B", as the bag moves to the B position. In the B position the jaw-like member 38 is extended through to bag's mouth so that the valve 32 is located adjacent the inner surface of the front wall 12A of the bag 10 and slightly below (e.g., 4 inches for a 25 pound bag) the top edge of that wall and generally centered between the gussets 12C and 12D. At the same time the jaw-like member 40 is located so that its heated contact surface 40A is aligned with the flange 32A of the valve 32.

When the carrier with the two jaw-like members 38 and 40 is in the position designated by the letter "C" the jaw-like members 38 and 40 are brought together as shown. At the C position the knife mechanism of the jaw 40 is extended outward to cut the vent hole through the wall 12A at the location of the valve and is then retracted backward out of the hole that it cut. The heated contact surface 40A of the jaw-like member 40 applies pressure to the underlying portion of the wall 12A of the bag and to the flange 32A of the valve, which is held in a fixed position by the jaw-like member 38. Thus, the heat and pressure applied welds the flange of the valve to the inner surface of the wall 12A of the bag.

Once this has been accomplished the bag and the jaw-like members 38 and 40 are then moved in unison to the position designated by the letter "D", whereupon the jaw-like members 38 and 40 are retracted together in the direction of arrows 44 so that the jaw-like member 38 is no longer within the bag's mouth and the jaw-like member 40 is no longer juxtaposed confronting the wall of the bag.

The two jaw-like members 38 and 40 are then carried by the carrier back to the position designated by the letter "A", whereupon another one-way valve is introduced in the cavity 38A of jaw 38 so that it can be applied to the next successive bag in the same manner as described above.

Once the jaw-like members 38 and 40 have been retracted from the bag, the bag with the valve secured to it is moved to the bag sealing station 30. As mentioned earlier that station is of conventional construction. As such the details of its construction and operation will not be described herein. Suffice it to state that as shown in FIG. 7 the bag sealing station 30 includes a pair of heated jaws 46 and 48 which are configured to be moved in the direction of arrows 50 to bring them together with the top edge portions of the front and rear walls 12A and 12B and the side gussets 12C and 12D interposed tightly therebetween, whereupon the mouth of the bag is sealed shut by a transverse seal line 10B.

This completes the formation, filling and sealing of the bag 10, whereupon the bag 10 is then moved out of the apparatus 20 and is ready to be palletized or otherwise stacked on similar bags 10. As will be appreciated by those skilled in the art since the vent hole is located in the wall of the bag contiguous with the one-way valve any air within the bag can pass or be forced from the interior of the bag through the valve and the vent hole to the ambient atmosphere, while the valve prevents ambient air and/or moisture from entering the bag. In order to ensure that the valve works properly and is not blocked by any portion of an immediately adjacent bag when the bag is palletized or otherwise stacked with other similar bags, the valve is preferably located closely adjacent the heat seal line 10B at the end of the bag 10. Thus, when a bag constructed in accordance with this invention is stacked up with other such bags, such as occurs during palletization, the valve of each bag is located at an end portion of the bag so that it can't be blocked by any portion of the immediately adjacent bag. As such air is enabled to exit out of the bags through their respective one-way valves, thereby ensuring that the stack of bags is stable.

It should be pointed out at this juncture that the embodiments of the apparatus and the methods as set forth above are merely exemplary so that other structure and operations can be carried out in accordance with the teachings of this invention.

Without further elaboration the foregoing will so fully illustrate my invention that others may, by applying current or future knowledge, adopt the same for use under various conditions of service.

I claim:

1. Apparatus for producing a bag filled with a flowable particulate material, said apparatus comprising:

plural stations, one of which being a valve applicator station, said at least one of said stations being configured to form a bag having an opened mouth from a continuous tube of flexible material and for introducing the flowable particulate material through the opened mouth into the bag to produce a filled bag, said apparatus being configured for moving said filled bag along a path through said valve application station;

said valve application station comprising a valve applicator mechanism and a cutting and heating mechanism, said valve applicator mechanism and said cutting and heating mechanism each being configured for movement along said path in synchronism with the movement of the bag along said path, said valve applicator mechanism being configured for holding a one-way valve and being configured to be introduced through the opened mouth of the bag for insertion within the bag at a predetermined position in said path as the bag is moved along said path to dispose the one-way valve against a portion of the interior of the bag, said cutting and heating mechanism also being configured to be moved with respect to the bag as the bag is moved along said path to dispose said cutting and heating mechanism outside of the bag and in alignment with the one-way valve to cut a vent hole in the bag as the bag is moved along said path and for thermally securing the one-way valve to the bag as the bag is moved along said path, said valve applicator mechanism and said cutting and heating mechanism also being configured to be moved away from the bag after the one-way valve is secured thereto and also moved backward along said path to said predetermined position to apply another one-way valve to another filled bag; and said apparatus being configured to seal the opened mouth of the bag after the one-way valve has been secured thereto.

2. The apparatus of claim 1, wherein said applicator mechanism and said cutting and heating mechanism are moved relative to each other to apply a force to the one-way valve and to an abutting portion of the bag to thermally secure the one-way valve to the bag.

3. The apparatus of claim 1, wherein said apparatus is configured so that the one-way valve is secured at a location in the bag closely adjacent the sealed mouth of the bag, whereby if a plurality of the bags are stacked upon one another the valve of each bag is not blocked by any portion of the immediately adjacent bag so that the stack of bags is stable.

4. The apparatus of claim 2, wherein said apparatus is configured so that the one-way valve is secured at a location in the bag closely adjacent the sealed mouth of the bag, whereby if a plurality of the bags are stacked upon one another the valve of each bag is not blocked by any portion of the immediately adjacent bag so that the stack of bags is stable.

5. Apparatus for use in a form, fill and seal machine for applying a one-way valve to a flexible bag having an opened mouth and filled with a flowable particulate material moving in a path through the machine, said apparatus comprising:

a valve applicator mechanism and a cutting and heating mechanism, each of which is configured for movement along said path in synchronism with the movement of the bag along said path, said valve applicator mechanism holding a one-way valve and being configured to be introduced through the opened mouth of the bag for insertion within the bag at a predetermined position in said path as the bag is moved along said path to dispose the one-way valve against a portion of the interior of the bag, said cutting and heating mechanism also being configured to be moved with respect to the bag as the bag is moved along said path to dispose said cutting and heating mechanism outside of the bag and in alignment with the one-way valve to cut a vent hole in the bag as the bag is moved along said path and for thermally securing the one-way valve to the bag as the bag is moved along said path, said valve applicator mechanism and said cutting and heating mechanism also being configured to be moved away from the bag after the one-way valve is secured thereto and also moved backward along said path to said predetermined position to apply another one-way valve to another filled bag.

6. The apparatus of claim 5, wherein said applicator mechanism and said cutting and heating mechanism are moved relative to each other to apply a force to the one-way valve and to an abutting portion of the bag to thermally secure the one-way valve to the bag.

7. The apparatus of claim 5, wherein the form, fill and seal machine is retrofitted with said apparatus.

8. The apparatus of claim 7, wherein said form, fill and seal machine initially comprises a vacuumization station and wherein said vacuumization station is replaced by said apparatus to form a valve applicator station.

9. The apparatus of claim 6, wherein the form, fill and seal machine is retrofitted with said apparatus.

10. The apparatus of claim 9, wherein said form, fill and seal machine initially comprises a vacuumization station and wherein said vacuumization station is replaced by said apparatus to form a valve applicator station.

11. A method of producing a bag filled with a flow able particulate material, said method comprising:

using an apparatus having plural stations, one of which being a valve applicator station;

providing a tube of flexible material to at least one of said stations to form a bag having an opened mouth;

introducing a flowable particulate material through said opened into said bag to produce a filled bag;

moving said filled bag along a path through said valve application station, said valve application station comprising a valve applicator mechanism and a cutting and heating mechanism;

moving said valve applicator mechanism and said cutting and heating mechanism along the path in synchronism with the movement of said bag along said path, said valve applicator mechanism holding a one-way valve;

introducing said valve applicator mechanism with said valve through said opened mouth into said bag at a predetermined position in said path as said bag is moved along said path to dispose said one-way valve against a portion of the interior of said bag;

moving said cutting and heating mechanism with respect to said bag as said bag is moved along said path to dispose said cutting and heating mechanism outside of said bag and in alignment with said one-way valve to cut a vent hole in said bag as said bag is moved along said path;

thermally securing said one-way valve to said bag as said bag is moved along said path;

moving said valve applicator mechanism and said cutting and heating mechanism away from said bag and backward along said path to said predetermined position to apply another one-way valve to another filled bag after said one-way valve is secured to said bag; and sealing the opened mouth of the bag after said one-way valve has been secured thereto.

12. The method of claim 11, wherein said applicator mechanism and said cutting and heating mechanism are moved relative to each other to apply a force to said one-way valve and to an abutting portion of said bag to thermally secure said one-way valve to said bag.

13. The method of claim 11, wherein said tube of flexible material is gusseted.

14. The method of claim 11, wherein said one-way valve is secured at a location in said bag closely adjacent said sealed mouth of said bag.

15. The method of claim 11, additionally comprising stacking a plurality of said bags on one another, wherein the valve of each bag is not blocked by any portion of the immediately adjacent bag so that the stack of bags is stable.

16. The method of claim 12, wherein said tube of flexible material is gusseted.

17. The method of claim 12, wherein said one-way valve is secured at a location in said bag closely adjacent said mouth of said bag.

18. The method of claim 12, additionally comprising stacking a plurality of said bags on one another, wherein the valve of each bag is not blocked by any portion of the immediately adjacent bag so that the stack of bags is stable.

19. A method of retrofitting a form, fill and seal machine having plural stations to produce a bag filled with a flowable particulate material from a tube of flexible material, said bag having an opened mouth and being moved in a path through the form, fill and seal machine, said method comprising:

providing said form, fill and seal machine with a valve applicator station, said valve application station comprising a valve applicator mechanism and a cutting and heating mechanism, each of which is configured for movement along said path in synchronism with the movement of the bag along said path, said valve applicator mechanism holding a one-way valve and being configured to be introduced through the opened mouth of the bag for insertion within the bag at a predetermined position in said path as the bag is moved along said path to dispose said one-way valve outside of the bag and against a portion of the interior of the bag, said cutting and heating mechanism also being configured to be moved with respect to the bag as the bag is moved along said path to dispose said cutting and heating mechanism in alignment with the one-way valve to cut a vent hole in the bag as the bag is moved along said path and for thermally securing said one-way valve to the bag as the bag is moved along said path, said valve applicator mechanism and said cutting and heating mechanism being configured to be moved away from the bag after said one-way valve is secured thereto and also moved backward along said path to said predetermined position to apply another one-way valve to another filled bag.

20. The method of claim 19, wherein said form, fill and seal machine initially comprises a vacuumization station and wherein said vacuumization station is replaced by said valve applicator station.

* * * * *